United States Patent [19]

Stracke

[11] Patent Number: 4,750,224

[45] Date of Patent: Jun. 14, 1988

[54] FLEXIBLE SUPPORT

[75] Inventor: Hans-Joachim Stracke, Berlin, Fed. Rep. of Germany

[73] Assignee: Jochen Simon, Berlin, Fed. Rep. of Germany; a part interest

[21] Appl. No.: 6,456

[22] Filed: Jan. 23, 1987

[30] Foreign Application Priority Data

Jan. 23, 1986 [DE] Fed. Rep. of Germany ..... 3602173

[51] Int. Cl.[4] ..... A47C 27/10; A61G 7/04

[52] U.S. Cl. ..... 5/455; 5/453

[58] Field of Search ..... 5/453, 455, 456, 449, 5/451, 450, 454

[56] References Cited

U.S. PATENT DOCUMENTS

| | | | |
|---|---|---|---|
| 2,491,557 | 12/1949 | Goolsbee | 5/455 |
| 2,655,369 | 10/1953 | Musilli | 5/455 |
| 3,008,465 | 11/1961 | Gal | 5/455 |
| 3,822,425 | 7/1974 | Scales | 5/456 |
| 3,909,858 | 10/1975 | Ducker | 5/455 |
| 4,279,044 | 7/1981 | Douglas | 5/453 |
| 4,297,755 | 11/1981 | Mollura | 5/455 |
| 4,525,885 | 7/1985 | Hunt et al. | 5/455 |

FOREIGN PATENT DOCUMENTS

| | | | |
|---|---|---|---|
| 122806 | 2/1919 | United Kingdom | 5/455 |

*Primary Examiner*—Alexander Grosz

*Attorney, Agent, or Firm*—Basile and Hanlon

[57] ABSTRACT

A flexible support acting as a cushion for the human body to sit or lie on and comprising: a plurality of hollow bodies which are disposed substantially in one plane and can be individually pressurized from inside by a flowable medium; and a solid base being for receiving the hollow bodies. When filled with the medium, the hollow bodies have substantially identical dimensions in two directions substantially perpendicular to one another and extending parallel with the aforementioned plane and are disposed in rows one beside the other in such directions. The surface of the base adjacent the hollow bodies is so shaped to adapt to the lower portion of the filled hollow bodies and engage them supportingly. The hollow bodies are preferably spherical when in the filled condition, and the surface of the support adjacent each hollow body is part-spherical in construction.

15 Claims, 2 Drawing Sheets

FLEXIBLE SUPPORT

BACKGROUND OF THE INVENTION

1. Field of the Invention

The invention relates to a flexible support acting as a cushion for the human body to sit or lie on.

2. Description of the Prior Art

U.S. Pat. No. 4,005,236 discloses a flexible support which consists of individual inflatable hollow bodies. In the un-inflated condition, the hollow bodies are folded and at a mutual distance from one another. When inflated, they unfold, so that in the inflated condition, they bear against and mutually support one another. The hollow bodies are disposed in rows in two directions perpendicular to one another and have, in the inflated condition, a rectangular cross-section parallel with their base, so that they form a self-contained sitting or lying surface. All the hollow bodies must, therefore, be inflated by substantially the same pressure, since, if the supporting effect of even only one hollow body fails, the whole sitting or lying surface may become unstable. The support function is, therefore, very adversely affected if even one of the hollow bodies is unable to maintain the required pressure due to a leak.

In hospitals, patients with external injuries are moreover, frequently not permitted to lie on a support in the area of such injuries, so that such areas of support are advantageously omitted from the lying surface. The formation of bed sores on particularly vulnerable parts of the body with prolonged hospitalization can also be avoided if, in the zone of such places, the lying surface is at least periodically altered that it exerts no pressure on the patient's body at the vulnerable place. This arrangement is not possible with the support known from U.S. Pat. No. 4,005,236, in which all the hollow bodies must have substantially an identical internal pressure, so that a lying surface with areas of differentiated resilience cannot be produced.

SUMMARY OF THE INVENTION

It is therefore an object of the invention to provide a flexible support acting as a cushion for the human body to sit or lie on and comprising a plurality of hollow bodies having a flexible envelope and a solid support, which bodies are disposed substantially in one plane and can be individually pressurized from inside by a flowable medium, and a base to support the hollow bodies. The hollow bodies filled with the medium have substantially identical dimensions in two directions perpendicular to one another and extending parallel with the aforementioned plane and are disposed in rows one beside the other in both such directions. Such support ensures a stable sitting or lying surface even if individual hollow bodies or individual groups of hollow bodies have an internal pressure which is negligible in comparison with that of the other hollow bodies.

A distinguishing feature of the invention is that the surface of the base adjacent each hollow bodies is so shaped as to be adapted to the lower portion of each of the filled hollow bodies, which it engages around supportingly. The base, therefore, gives each hollow body a firm seating and prevents the loaded hollow body from yielding, so that there is no need for the filled hollow bodies to support one another. For this reason any selected number of the individual hollow bodies can be subjected to highly differentiated internal pressures.

Preferably the hollow bodies are spherical in the filled condition and each surface of the base adjacent the hollow bodies is part-spherical in construction. As a result, the surface of the base can be completely adapted to the hollow bodies in a very simple manner. The hollow bodies are slightly deformed by the load of the human body, so that the inherently nearly spot-type contact surface is substantially enlarged. Moreover, the hollow bodies are selected small enough in size to give the particular person the feeling of a self-contained sitting or lying surface.

Advantageously the hollow bodies are mounted so as to be individually removable from and insertable into the base, so that damaged hollow bodies can be interchanged in a problem-free manner. Such interchange is facilitated by the hollow bodies exerting no pressure on one another, even in the filled condition.

A particularly preferred support is obtained if the envelope of the hollow bodies consists of a foam material, such as, for example, neoprene, with closed cavities whose volume can be altered by the pressure of the flowable medium. The cavities represent air inclusions which have a considerable thermal insulating effect. The cavities are compressed to a varying extent, in dependence on the pressure inside the hollow body, so that when pressure rises inside the hollow body, the heat transfer resistance of the envelope decreases. The person sitting or lying thereon can, therefore, be given the feeling of a pleasant temperature by a suitable adjustment of the internal pressure of the hollow bodies. On the outside of the hollow body, the foam material is advantageously coated with another material, by means of which coating further required properties can be conferred on the hollow body. The coating can be, for example, a material which is particularly compatible with the skin. It can also be substantially non-resilient, so that the shape of the filled hollow body is practically unchanged, independently of the pressure in the hollow body.

The hollow body preferably has a valve to control the admission and discharge of the flow of the medium.

More particularly, when the support is used as a cushion to lie on, the base can consist of at least two interconnected parts which can be pivoted in relation to one another around their connecting axis, so that a vertically adjustable head and/or foot end is obtained.

BRIEF DESCRIPTION OF THE DRAWINGS

The invention will now be described in greater detail with reference to an embodiment thereof illustrated in the drawings, wherein.

DETAILED DESCRIPTION OF THE PREFERRED EMBODIMENT

Figure 1:
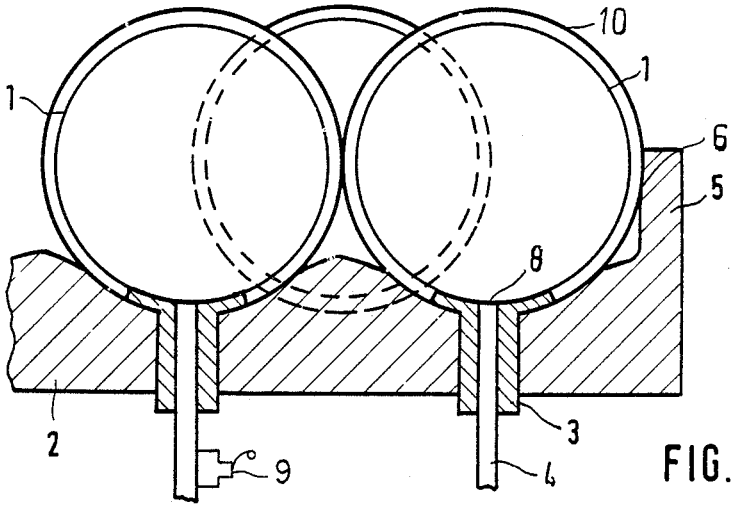
FIG. 1 is a vertical section through a portion of the support, taken along the line I—I in FIG. 2.

FIG. 1 shows two hollow bodies 1 which are disposed one beside the other and borne by a base 2. The hollow bodies 1 are pressurized from inside by a gas or a liquid, assuming, as a result, a spherical shape. At the places intended for receiving the hollow bodies 1, and base 2 has part-spherical depressions which are adapted to the spherical shape of the hollow bodies 1. The hollow bodies 1 are, therefore, borne firmly in the part-spherical depressions in the surface of the base 2 and are retained securely against yielding laterally. The envelope 6 of the hollow bodies 1 preferably consists of neoprene with a coating 10 disposed thereon.

The hollow bodies 1 can be produced, for example, by two flat blanks of foam material or the like connected by annular gluing, such gluing being, if necessary, additionally secured by a seam or clamp. The envelope 6 of the hollow bodies 1 is formed with an aperture 8 in which one end of a tube 4 is attached by means of an attaching spigot 3. A valve 9 can be used to control the admission and discharge of a flowable medium, preferably air, into and from the hollow bodies 1 via the tube 4. A compressed air source (not shown) is disposed at the other end of the tube 4. The compressed air source itself can also be controlled in a suitable manner. Since the support has a large number of hollow bodies 1, pressure can be applied periodically without feeling unpleasant to the person lying on the support. In this way, the occurrence of bed sores can be avoided in patients lying motionless for a prolonged period. A cavity diameter in a range between 5 and 10 cm is needed for a lift of about 5 cm achievable by the inflation of the hollow bodies 1. Such a lift is regarded as adequate.

Figure 2:
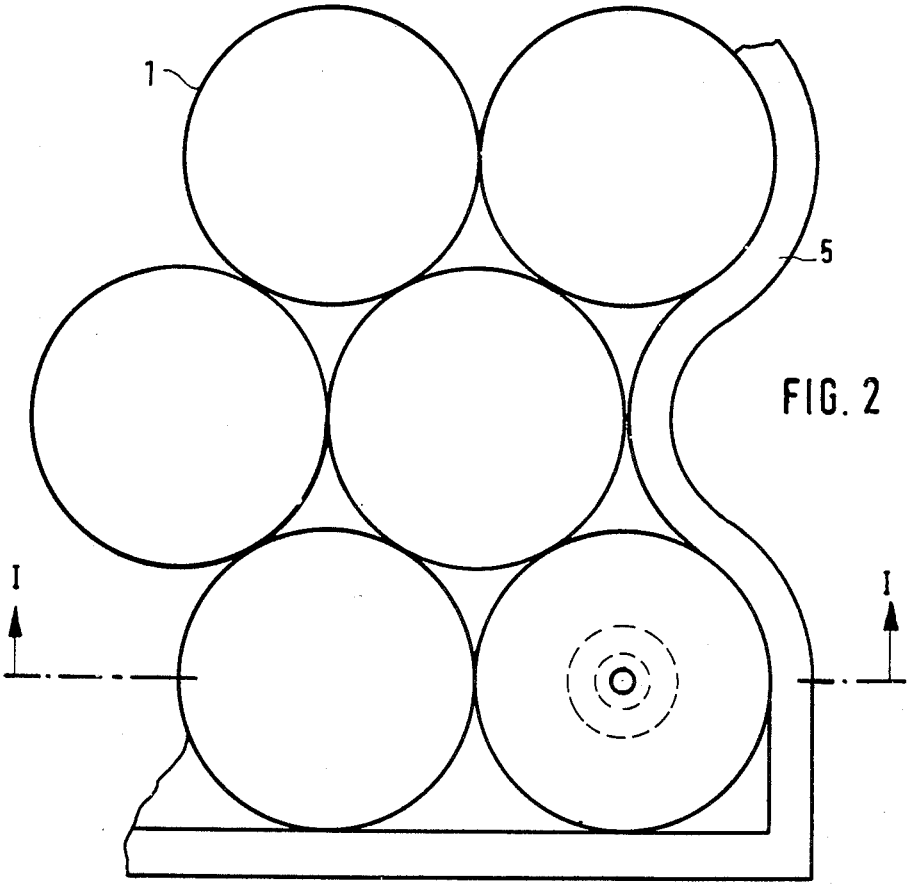
FIG. 2 is a plan view of a portion of the support.

The arrangement of the hollow bodies 1 in adjacent rows is offset in one direction by half the distance between two adjacent hollow bodies, to obtain as large a number of hollow bodies as possible over a given area. In FIG. 2, the hollow bodies are shown offset in the horizontal direction. At the edges of the support, the base 2 has a raised edge 5 which follows the offset ends of the individual rows of hollow bodies.

Figure 3:
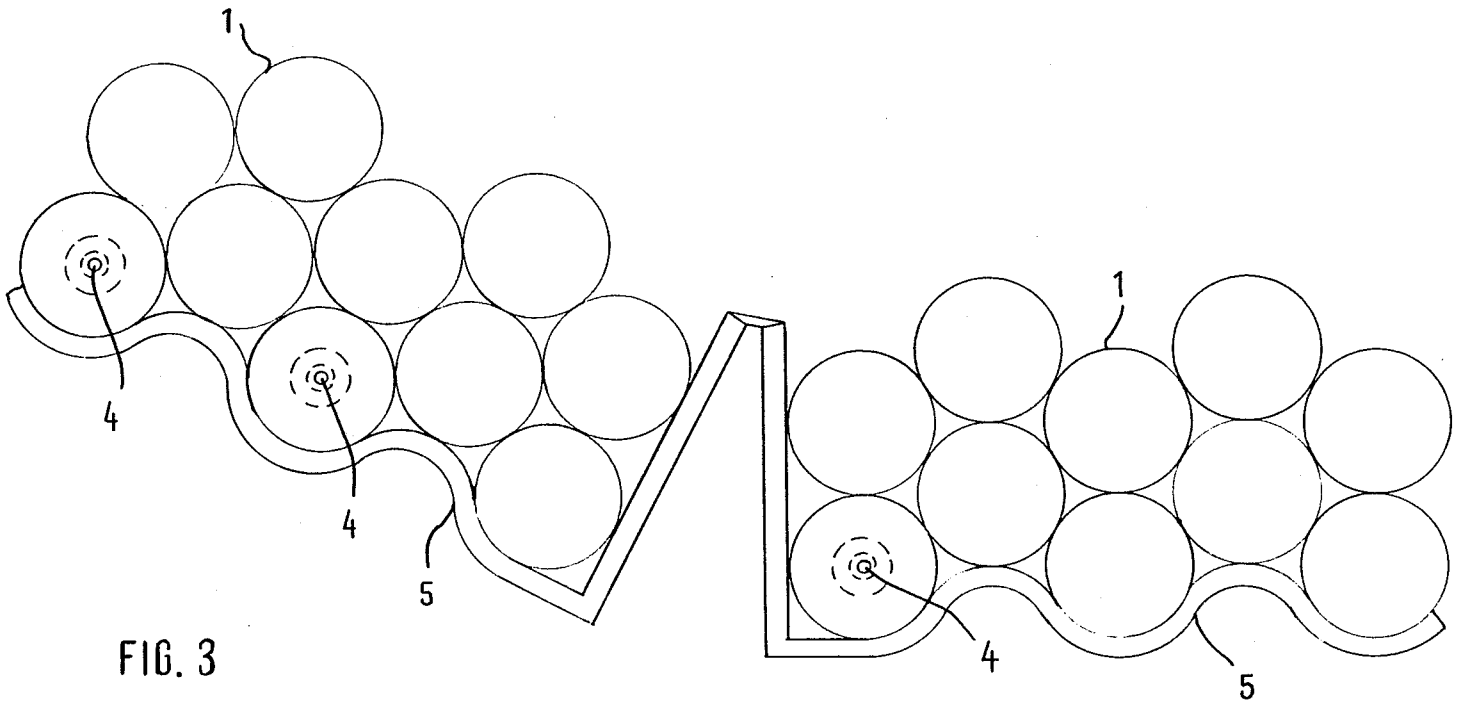
FIG. 3 is a vertical section through a portion of a support comprised of two interconnected parts.

As can be seen by reference to FIG. 3, the support of the instant invention can comprise at least tow interconnected parts. The two interconnected parts can be pivoted in relation to one another around their connecting axis so that, for example, a vertically adjustable head or foot may be obtainable.

What is claimed is:

1. A flexible support acting as a cushion for the human body comprising a plurality of hollow bodies having part spherical lower portions each formed by a flexible envelope, said hollow bodies having top portions being disposed substantially in one plane and individually pressurizable from inside by a flowable medium, the hollow bodies having substantially identical dimensions in two directions perpendicular to one another and extending parallel with the plane and being disposed in rows one beside the other in such directions, wherein the surface of a supporting base adjacent the hollow bodies has part-spherical depressions which are adapted to engage and surround the lower portion of each of the filled hollow bodies.

2. A support according to claim 1 wherein the hollow bodies are mounted so as to be individually removable from and insertable in the base.

3. A support according to claim 1, wherein the envelope is comprised of foam material with closed cavities whose volume changes in response to changes in the pressure of the flowable medium.

4. A support according to claim 3, wherein the foam material is neoprene.

5. A support according to claim 4, wherein the foam material is coated with another material.

6. A support according to claim 3, wherein the foam material is coated with another material.

7. A support according to claim 6 wherein the coating of the foam material is substantially non-resilient.

8. A support according to claim 1, wherein each of the hollow bodies has a valve for controlling the admission and discharge of the flowable medium.

9. A support according to claim 1, wherein the base consists of at least two interconnected parts which can be pivoted in relation to one another around a connecting axis.

10. A flexible support acting as a cushion for the human body comprising a plurality of hollow bodies each formed by a flexible envelope, said hollow bodies having top portions disposed substantially in one place, said hollow bodies being individually pressurizable from inside by a flowable medium, the admission and discharge of said flowable medium being controllable by a valve provided for each hollow body, the hollow bodies having substantially identical dimensions in two directions perpendicular to one another and extending parallel with the plane and being disposed in rows one beside the other in such directions, wherein the surface of a base adjacent the hollow bodies is adapted to engage and surround the lower portion of each of the filled hollow bodies, said hollow bodies being spherical in the filled condition and each surface of the base adjacent the hollow bodies being part-spherical in construction, wheren the hollow bodies are individually insertable and removable from the base.

11. A support acconrding to claim 10, wherein the envelope is comprised of foam material with closed cavities whose volume changes in response to changes in the pressure of the flowable medium.

12. A support according to claim 11, wherein the foam material is neoprene.

13. A support according to claim 12, wherein the foam material is coated with another material.

14. A support according to claim 11, wherein the foam material is coated with another material.

15. A support according to claim 10, wherein the base consists of at least two interconnected parts which can be pivoted in relation to one another around a connecting axis.

* * * * *